US006722770B2

(12) United States Patent
Colangelo

(10) Patent No.: US 6,722,770 B2
(45) Date of Patent: Apr. 20, 2004

(54) UNIFORM EPAULET-COUPLED, ENHANCED FLASHLIGHT

(76) Inventor: David W. Colangelo, 10 Feather La., Jackson, NJ (US) 08527

( * ) Notice: Subject to any disclaimer, the term of this patent is extended or adjusted under 35 U.S.C. 154(b) by 0 days.

(21) Appl. No.: 10/223,730

(22) Filed: Aug. 20, 2002

(65) Prior Publication Data

US 2004/0037066 A1 Feb. 26, 2004

(51) Int. Cl.[7] ..... F21V 21/08; F21L 4/02

(52) U.S. Cl. ..... 362/103; 362/184; 362/191; 362/197; 362/200; 362/231

(58) Field of Search ..... 362/103, 108, 362/190, 191, 184, 197, 199, 200, 800, 231

(56) References Cited

U.S. PATENT DOCUMENTS 4,228,485 A * 10/1980 Hubbard et al. ..... 362/191
4,417,299 A * 11/1983 Rupp ..... 362/186
4,963,798 A * 10/1990 McDermott ..... 362/231
6,015,217 A * 1/2000 Colangelo et al. ..... 362/103
6,168,288 B1 * 1/2001 St. Claire ..... 362/184
6,485,160 B1 * 11/2002 Sommers et al. ..... 362/184
6,517,215 B2 * 2/2003 Mele ..... 362/203

* cited by examiner

*Primary Examiner*—Alan Cariaso
(74) *Attorney, Agent, or Firm*—Charles I. Brodsky

(57) ABSTRACT

A flashlight in a housing of given size dimension to fit within and under a shoulder epaulet on an article of clothing worn as part of a uniform by a person engaged in law enforcement or emergency medical service activity, for example, with a fastener at a top surface of the housing in the nature of a clip to secure to the shoulder epaulet in providing hands-free operation. A plurality of light emitting diodes along with a mirrorized surface increases the intensity of visibility through a front end of the flashlight in viewing an area, with a plurality of light emitting diodes generating a rearwardly extending beam as a warning light to oncoming vehicular traffic, either with or without a like mirrorized reflector.

9 Claims, 5 Drawing Sheets

UNIFORM EPAULET-COUPLED, ENHANCED FLASHLIGHT

CROSS-REFERENCE TO RELATED APPLICATIONS

None

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not applicable

BACKGROUND OF THE INVENTION

1. Field of the Invention

This invention relates to the field of law enforcement and, more particularly, to an improvement in the uniform epaulet-coupled emergency flashlight of my U.S. Pat. No. 6,015,217, issued Jan. 18, 2000.

2. Description of the Related Art

As my prior patent indicated, law enforcement, military police, corrections officers, border patrol, etc. usually carry flashlights of a type which can be grabbed by persons being questioned, and used as a weapon against an interrogating officer. My above patent described a flashlight which allowed the officer's hands to be free for use, and to enable the officer to react quickly to any attempt to injure or seriously place him/her in harm's way. Such flashlight then placed the officer at an advantage, rather than at a disadvantage.

As therein described, the flashlight was worn as part of a uniform, securable to a shoulder epaulet. A front end was rotatable upwardly and downwardly to generate and spread a light beam in use—or to be hooded closed, concealing the nature of the housing as an illuminating source when not being so employed. A flashing light was additionally included to illuminate through a back end as a rearwardly projecting beam in serving as a warning to oncoming motorists approaching from behind.

SUMMARY OF THE INVENTION

The present invention will be appreciated to extend the concept of this flashlight still further, in enhancing the quantity and quality of the light both forwardly and rearwardly, yet without increasing the size of the flashlight to any meaningful extent. At the same time, the flashlight of this invention will be seen to provide its operation in a variety of outdoor conditions—and especially in harsh environments where inclement weather conditions exhibited a tendency to rust or otherwise wear individual ones of the component parts of my earlier design. Realizing at the same time that uniforms worn by various law enforcement personnel both in the civilian and military fields oftentimes may differ, the flashlight of the present invention will be seen to be one in which a snug fit is insured on virtually every uniform design in use today.

Thus, and as will be seen from the description below, the enhanced uniform epaulet-coupled flashlight of the present invention incorporates a mirrorized reflector coupled with the front and rear lenses to increase and intensify visibility.

At the same time, the single candle bulb utilized in generating the forward extending light beam of my prior construction is replaced by a plurality of ultra-bright light-emitting diodes (LEDs), while the halogen bulb utilized in generating the rearward extending beam is similarly replaced by a plurality of such LEDs—preferably of differing color combination to provide an increased observer awareness. Rechargeable nickel-metal hydride batteries are employed instead of double-A or triple-A alkaline batteries—preferable even to rechargeable ni-cad batteries. Additionally, and as will be seen, the rotating front lens which acted as an on-off switch for the flashlight itself is modified to be a 90° rotating head, instead of the 180° rotating head as in my earlier design—both for purposes of reliability in operation and so as to present less of a metal rotating clip in operation, which analysis has shown might rust or otherwise be adversely affected when used during rain, sleet, snow or similar inclement weather conditions.

Able to alert oncoming motorists of an officer's presence with a preferred stroboscopic light configuration in its rear, the flashlight of the present invention will be appreciated to be one offering upwards of 100,000 continuous hours of life without the need for a bulb replacement. When packaged along with an epaulet extender, the flashlight could then be secured with a wide variety of uniform designs.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
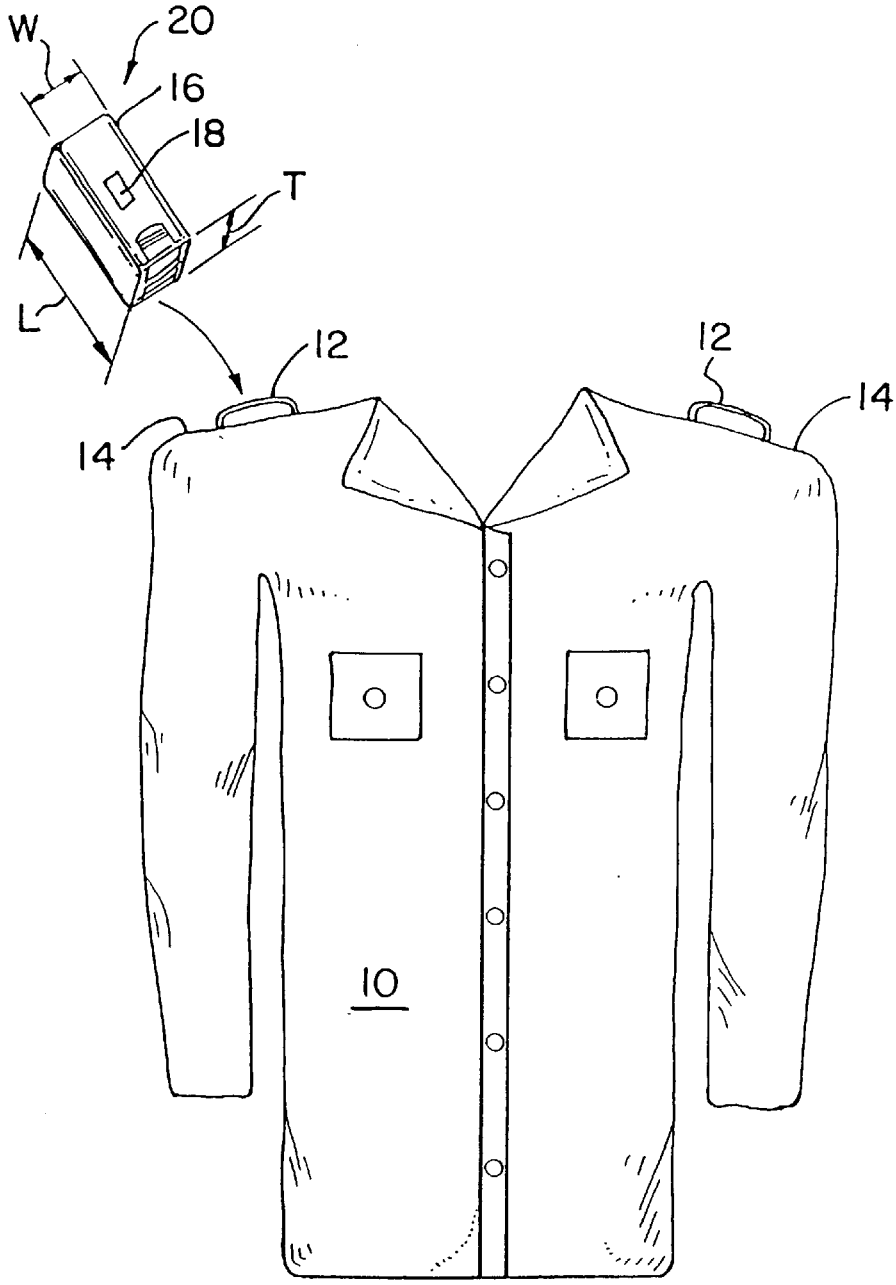
FIG. 1 illustrates a law enforcement uniform shirt or jacket having a shoulder epaulet of a configuration commonly employed, or fabricated as such for use in accordance with the teachings of the invention, comparable to that shown in my U.S. Pat. No. 6,015,217.

In FIG. 1, reference numeral 10 identifies a uniform shirt of the type worn by law enforcement personnel in the spring or summer, or a uniform jacket worn in the fall or winter, along with the shoulder epaulet 12 usually found at the shoulder 14—and if not so included, then to be added there in accordance with the teachings of both this, and of my earlier, invention. As also shown, a flashlight 20 in a housing 16 is intended for placement within and under the epaulet 12, with a fastener 18 simplified greatly at its top surface 21 to be secured to the epaulet when so inserted. Selected of dimension to fit within and under the epaulet 12 in a manner to be fastened to it as by a clip in a snug manner as to be further described, the housing 16 may be of generally rectangular cross-section. In a preferred embodiment, the housing 16 may be of a width "W" of the order of 1½–2½ inch and of a thickness "T" of the order of ¾–1 inch. Such housing 16 may be fabricated of plastic, or any other appropriate material, and of a length "L" of the order of 3–5 inches.

Figure 2:
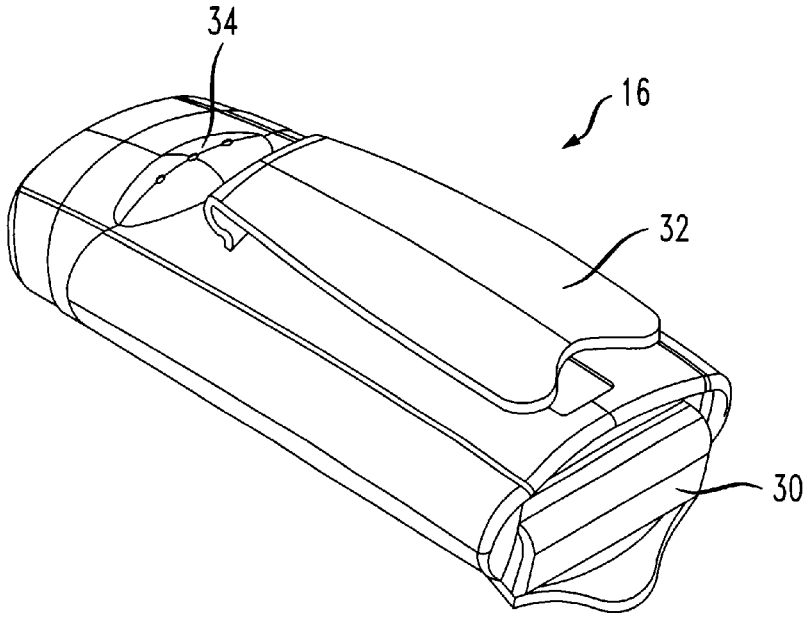
FIGS. 2–8 are illustrative views of an assembled flashlight constructed in accordance with the invention, helpful in an understanding of the flashlight being turned "on" and "off", and in a manner to illuminate, amongst other things, papers held by a law enforcement officer in a "hands-free" manner of flashlight illumination like with the operation of my prior patent.
Figure 3:
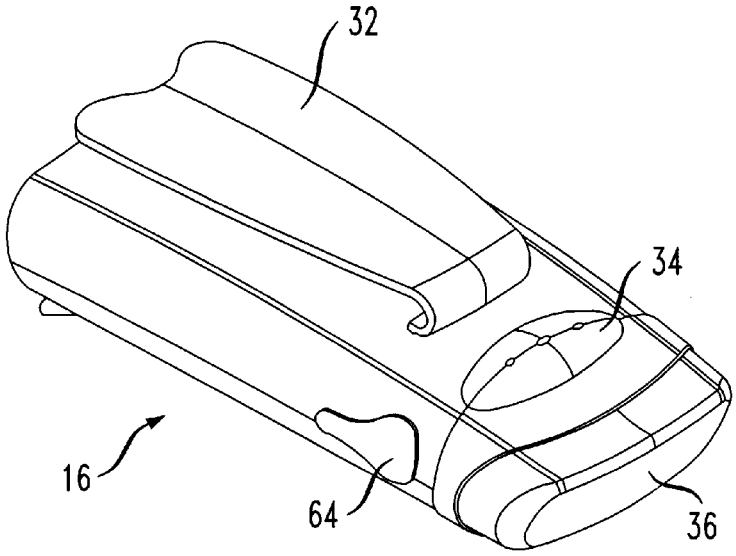
Figure 4:
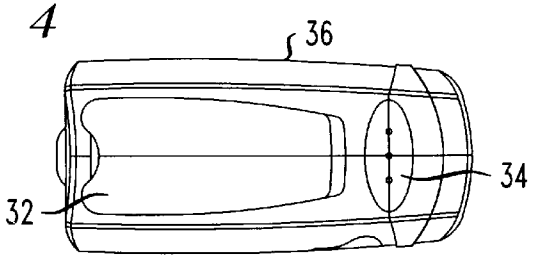
Figure 8:
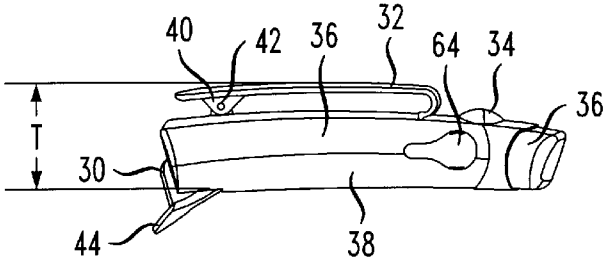
Figure 5:
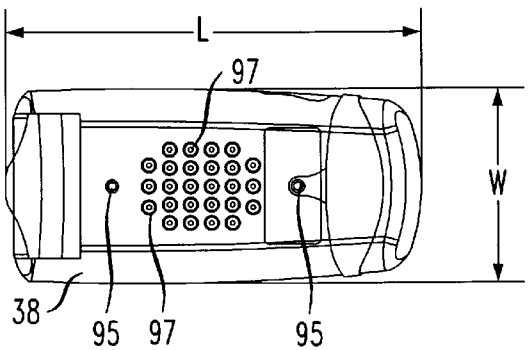
Figure 6:
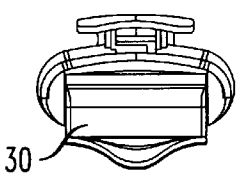
Figure 7:
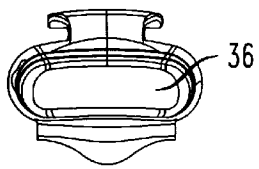

FIGS. 2–8 more particularly illustrate views of a preferred embodiment of the flashlight of the invention in assembled form. More specifically, FIG. 2 illustrates a front perspective view of the housing 16 showing its front lens cover 30, its securing clip 32 and an on-off switch cap 34 for energizing LEDs in generating a rearward extending beam. FIG. 3, on the other hand, is a rear perspective view of the housing 16 showing a rear lens 36. A top view of the housing 16 is shown in FIG. 4, while a bottom view is shown in FIG. 55, where reference numerals 95 represent a pair of screws in fastening the housing together. The top cover of the housing is shown at 36 while the bottom cover is shown at 38. A plurality of vent holes is provided in the bottom cover 38, as at 97. In the embodiment of the invention shown in FIGS. 2–5, the length "L" was selected to be 4.450 inch and the width "W" was selected to be 2.083 inch. FIG. 6 is a end view looking at the front lens 30 of FIG. 2, while FIG. 7 is an end view looking at the rear lens 36 of FIG. 3. FIG. 8 is a left side view of the housing 16 of FIG. 3 with its front lens 30 open in a downward position, and with reference numerals 40 and 42 identifying a spring and a pin, respectively, for fastening the clip 32 to the epaulet 12. A housing for the front lens 30 is shown at 44 for opening and hooding the front lens compartment. In the preferred embodiment of the invention, the overall thickness for the housing and the clip, shown as "T" was selected to be 1.127 inch.

Figure 9B:
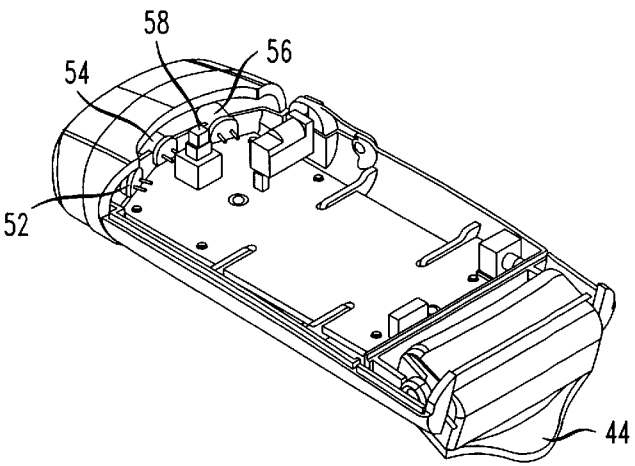
FIGS. 9*a*–9*c*, 10*a*–10*c* and 11 are disassembled views of the components parts of the improved flashlight of this invention, helpful in an understanding of its advancements over my previous construction.
Figure 9C:
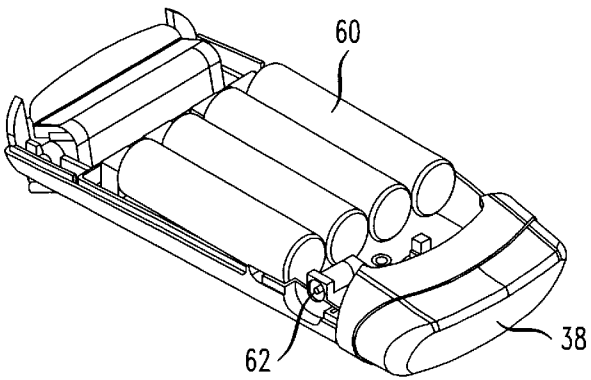
Figure 9A:
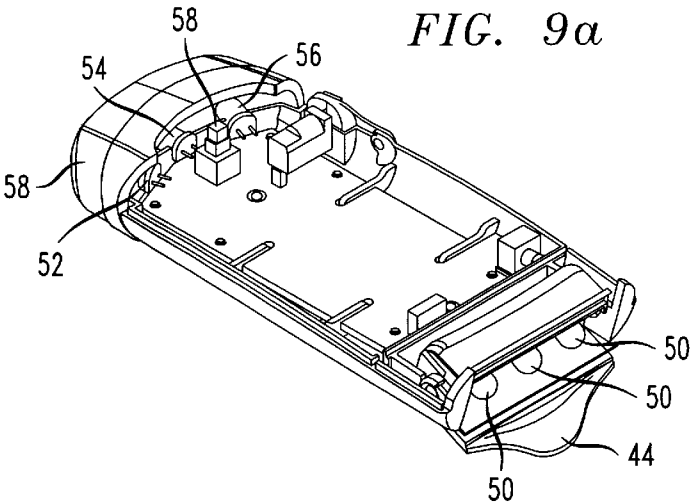

FIGS. 9*a*–9*c* are helpful in understanding some of the improvements of the flashlight of this invention as contrasted with that of my earlier design. FIGS. 9*a* and 9*b* show the front lens "on-off" switch as being rotatable only 90° in exposing three ultra-bright light-emitting diodes 50 in providing thousands of continuous hours of life before the need for replacement. In FIG. 9*a*, the LEDs 50 are exposed, while in FIG. 9*b*, the LEDs 50 are hooded closed. Rotating the lens cover 44 from the position shown in FIG. 9*b* to that shown in FIG. 9*a* switches the LEDs 50 "on", while rotating the lens cover 44 in the opposite direction turns the LEDs 50 "off", besides hooding them.

FIGS. 9*a* and 9*b* also show three LEDs 52, 54, 56 behind the rear lens 38 to provide a stroboscopic effect when energized, as by the depressing the rear cap switch 34 of FIG. 2 in actuating the plunger type control 58 of FIGS. 9*a* and 9*b*, which rests beneath it. To heighten even more the stroboscopic effect, these LEDs 52, 54, 56 may be of differing colors, one from another, as by having the two outer ones illuminate "red", and the inner one illuminate "white". FIG. 9*c* also shows a nickel-metal hydride rechargeable battery pack 60, of 4.8 volt. As will be appreciated by those skilled in the art, nickel-metal hydride batteries are able to avoid many of the charging memory problems associated with nickel/cadmium rechargeable batteries, and exhibit an average one week's time of standard use once fully charged, before needing another charge. Recharging is by way of a standard pin shown as 62 in FIG. 9*c*, accessible by removal of the cover 64 in FIGS. 3 or 8. As FIGS. 9*a*–9*c* illustrate, only the front cover 44 is rotatable in acting as the "on-off" switch for the illumination of the forward facing LEDs 50, with a tapping of the cap 34 being sufficient to energize the rearward facing LEDs, and to then turn them "off".

Figure 10A:
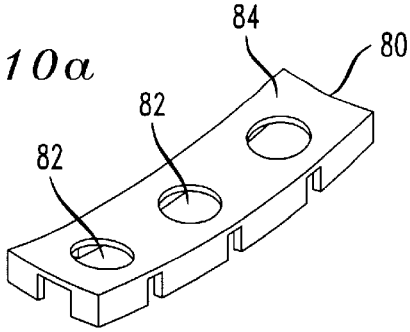
Figure 10B:
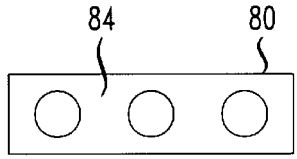
Figure 10C:
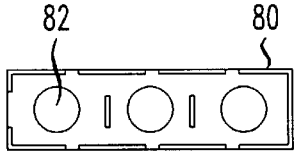

Pairs of mirrorized reflectors are added with the invention, coupled with the front and rear lenses to increase and intensify the visibility of the light emitting diodes employed. With FIG. 10*a* representing a perspective view of these reflectors 80, and FIG. 10*b* and 10*c* representing top and bottom views respectively, the three apertures provided 82 are sized to encircle the LEDs in providing a further reflective surface for their illuminations. With the mirrorized coating being on the top surface 84 only, the end result is an intensification of the light beam generated downwardly on the paperwork being reviewed by an investigating officer, and an intensification even more of the rearwardly produced stroboscopic effect alerting the oncoming motorist. With the LEDs offering up to 100,000 continuous hours of life and more, and with the nickel-metal hydride batteries affording significant increases in battery life, a 30%–50% reduction in electrical consumption is further offered in enhancing operation.

Figure 11:
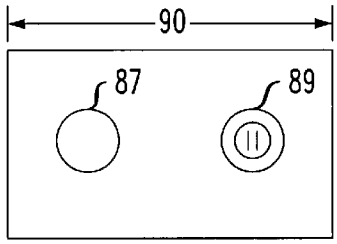

Recognizing that not all uniform shirts or jackets may come with an epaulet of length to permit ready insertion of a flashlight of this type under it, the flashlight of the invention could be packaged along with an epaulet extender to ensure a snug fit on virtually every uniform. Such an extender is shown in FIG. 11, of approximately 1¼ inch length 90 and of an elasticized composition in allowing its opening 87 to receive the already present button on the uniform, and a button 89 to couple to the shirt or jacket.

While there has been described what is considered to be a preferred embodiment of the present invention, it will be readily appreciated by those skilled in the art that modifications can be made without departing from the scope of the teachings herewith. For example, in a manner similar to that set out with respect to the flashlight of my U.S. Pat. No. 6,015,217 design, the improved flashlight of this description could be used by emergency medical service technicians or by others besides law enforcement personnel. And, in similar manner, while the invention has been described utilizing light emitting diodes in groupings of "three", other combinations can be employed, of either the same or differing colors in projecting a rearward beam stroboscopically or otherwise, and other than three light emitting diodes could be used in generating the forward extending beam in illuminating an area while permitting unfettered use of one's hands. Also, while mirrorized reflectors have been described as being highly advantageous when employed with both the forward and rearward facing plurality of light emitting diodes, either one could be eliminated and yet the flashlight still provide enhanced operation over that previously available. For at least such reasons, therefore, resort should be had to the claims appended hereto for a true understanding of the invention.

I claim:

1. The combination comprising:

a flashlight in a housing of given size dimension having a fastener at a top surface thereof; and a shoulder epaulet on an article of clothing;

with said flashlight being selected of size dimension to fit said flashlight within said epaulet when said article of clothing is worn, with said fastener of said housing being secured to said epaulet, and with said flashlight including a front end through which a light beam is generated by a first plurality of included light-emitting diodes and a mirrorized reflector;

wherein said flashlight also includes a back end through which a light beam is generated by a second plurality of included light-emitting diodes and a mirrorized reflector;

wherein said first plurality of light-emitting diodes provides a steady light beam in use, and wherein said second plurality of light-emitting diodes provides a flashing light beam in use; and wherein individual ones of said second plurality of light-emitting diodes provide illumination in differing colors.

2. The combination of claim 1 wherein said flashlight front end is rotatable from an initial quiescent position to turn "on" the light beam generated by said flashlight, and is rotatable back to said initial quiescent position to turn said light beam "off".

3. The combination of claim 1 wherein said flashlight includes separate on-off controls for each of said first and second plurality of light-emitting diodes.

4. The combination of claim 3 wherein said flashlight back end includes a tapping switch to alternatively turn said second plurality of light-emitting diodes "on" and "off".

5. The combination of claim 3 wherein at least one of said first and second plurality of light-emitting diodes is powered by a rechargeable battery included within said flashlight.

6. The combination of claim 3 wherein each of said first and second plurality of light-emitting diodes is powered by a rechargeable nickel-metal hydride battery included within said flashlight.

7. The combination of claim 1 wherein each of said first and second mirrorized reflectors include a series of apertures sized to encircle its associated plurality of light-emitting diodes.

8. The combination of claim 1 wherein said flashlight housing is selected of a size dimension to snugly fit within and under said shoulder epaulet, and wherein said fastener includes a clip to secure to said epaulet.

9. The combination of a flashlight in a housing of given size dimension having a fastener at a top surface thereof; and a shoulder epaulet on an article of clothing;

with said flashlight being selected of size dimension to fit said flashlight within said epaulet when said article of clothing is worn, with said fastener of said housing being secured to said epaulet, and with said flashlight including a front end through which a light beam is generated by a plurality of included light-emitting diodes and a mirrorized reflector;

wherein said flashlight housing is of rectangular cross-section of a width and thickness to fit under said shoulder epaulet;

wherein said shoulder epaulet is included on an article of clothing as worn by a person engaged in law enforcement or emergency medical service activity; and wherein said shoulder epaulet housing is extendable in length to snugly receive said flashlight housing in position.

* * * * *